US010378174B2

(12) United States Patent
Kuriger et al.

(10) Patent No.: US 10,378,174 B2
(45) Date of Patent: Aug. 13, 2019

(54) INTERFACE FOR COUPLING WORK TOOL TO MACHINE

(71) Applicant: Caterpillar Inc., Peoria, IL (US)

(72) Inventors: Karl S. Kuriger, Raleigh, NC (US); Paul E. Pottschmidt, Raleigh, NC (US)

(73) Assignee: Caterpillar Inc., Deerfield, IL (US)

( * ) Notice: Subject to any disclaimer, the term of this patent is extended or adjusted under 35 U.S.C. 154(b) by 353 days.

(21) Appl. No.: 15/270,157

(22) Filed: Sep. 20, 2016

(65) Prior Publication Data

US 2018/0080192 A1 Mar. 22, 2018

(51) Int. Cl.
*E02F 3/36* (2006.01)
*E02F 3/96* (2006.01)

(52) U.S. Cl.
CPC ..... *E02F 3/3604* (2013.01); *E02F 3/963* (2013.01); *E02F 3/964* (2013.01)

(58) Field of Classification Search
CPC ..... E02F 3/963; E02F 3/96; E02F 3/3604
See application file for complete search history.

(56) References Cited

U.S. PATENT DOCUMENTS 3,591,935 A * 7/1971 Bremmer ..... E02F 3/3604 172/819
4,706,762 A * 11/1987 Harms ..... E02F 3/963 172/684.5
5,121,557 A * 6/1992 Moore ..... E02F 3/3677 37/406
5,556,217 A 9/1996 Deyo et al.
5,957,213 A 9/1999 Loraas et al.
6,499,934 B1 12/2002 Kaczmarski et al.
6,776,571 B2 * 8/2004 Riffle ..... B66F 9/065 37/468
7,524,158 B2 4/2009 Eckstein et al.
7,877,906 B2 * 2/2011 Ramun ..... B23D 31/008 37/403
2006/0157605 A1 * 7/2006 Ramun ..... E02F 3/302 241/266
2014/0317967 A1 10/2014 Parker et al.
2016/0138249 A1 5/2016 Conway et al.
2016/0362145 A1 * 12/2016 Kuriger ..... A01B 59/066

FOREIGN PATENT DOCUMENTS

WO 2001088280 10/2002

OTHER PUBLICATIONS

Xboom Excavator Coupler System [online], (retrieved on Jun. 16, 2016) Retrieved from the Xboom Excavator Coupler website using internet <URL: http://xboomcoupler.com>, pp. 2-5.

* cited by examiner

*Primary Examiner* — Gerald McClain

(57) ABSTRACT

An interface for coupling a work tool to a stick of a machine includes a plate having an engaging face and a coupling face. The engaging face of the plate is connected to the work tool. The interface also includes a first bracket and a second bracket positioned at a predefined distance from the first bracket. The first bracket and the second bracket extend from the coupling face of the plate and include at least one first hole and at least one second hole, respectively. The interface also includes a first pin received through the at least one first hole and the at least one second hole, and connected to a coupling member. The coupling member is connected to the stick of the machine and is configured to couple the work tool to the stick of the machine.

12 Claims, 4 Drawing Sheets

INTERFACE FOR COUPLING WORK TOOL TO MACHINE

TECHNICAL FIELD

The present disclosure relates to work tools of machines, and more particularly to an interface for coupling a work tool to a machine.

BACKGROUND

Based on tasks required to be performed by a machine, various work tools are coupled to the machine. For example, a multi-purpose bucket is coupled to a skid steer loader for raising material from a worksite, and a trencher is coupled to the skid steer loader to dig a trench at the worksite. In cases where such tasks need to be performed at a location away from a frame of the machine, an excavator machine is used. However, it is difficult to mount skid steer loader work tools on the excavator machine.

US Patent Publication Number 2014/0317967 (the '967 publication) describes an excavator having an undercarriage assembly and a turret assembly rotatable relative to the undercarriage assembly. The undercarriage assembly has an undercarriage implement support that may pivot about a lift axis. An undercarriage coupler is coupled to the undercarriage support and includes an undercarriage coupler interface that is configured to operably engage an undercarriage implement interface provide on an undercarriage implement. The turret assembly also carries a turret implement, and therefore the excavator may simultaneously employ both the undercarriage implement and the turret implement. However, the '967 publication does not disclose a manner in which the undercarriage implement interface can be coupled to a stick end of the excavator.

SUMMARY OF THE DISCLOSURE

In one aspect of the present disclosure, an interface for coupling a work tool to a stick of a machine is provided. The interface includes a plate having an engaging face and a coupling face opposite to the engaging face. The engaging face of the plate is connected to the work tool. The interface also includes a first bracket and a second bracket positioned at a predefined distance from the first bracket. The first bracket and the second bracket extend from the coupling face of the plate and include at least one first hole and at least one second hole, respectively. The at least one second hole is aligned with the at least one first hole. The interface also includes a first pin received through the at least one first hole and the at least one second hole, and connected to a coupling member. The coupling member is connected to the stick of the machine and is configured to couple the work tool to the stick of the machine.

In another aspect of the present disclosure, a machine is provided. The machine includes a frame, a stick having a first end and a second end, where the first end of the stick is pivotally coupled to the frame. The machine also includes an interface for coupling a work tool to the stick. The interface includes a plate having an engaging face and a coupling face opposite to the engaging face. The engaging face of the plate is connected to the work tool. The interface also includes a first bracket and a second bracket positioned at a predefined distance from the first bracket. The first bracket and the second bracket extend from the coupling face of the plate and include at least one first hole and at least one second hole, respectively. The at least one second hole is aligned with the at least one first hole. The interface also includes a first pin received through the at least one first hole and the at least one second hole. The machine further includes a coupling member having a first engaging portion configured to engage with the first pin of the interface. The engagement of the first pin and the first engaging portion allows coupling of the interface with the stick of the machine.

In yet another aspect of the present disclosure, an interface assembly for coupling a work tool to a stick of a machine is provided. The interface assembly includes an interface. The interface includes a plate having an engaging face and a coupling face opposite to the engaging face. The engaging face of the plate is connected to the work tool. The interface also includes a first bracket and a second bracket positioned at a predefined distance from the first bracket. The first bracket and the second bracket extend from the coupling face of the plate and include at least one first hole and at least one second hole, respectively. The at least one second hole is aligned with the at least one first hole. The interface also includes a first pin received through the at least one first hole and the at least one second hole. The interface assembly also includes a coupling member having a first engaging portion configured to engage with the first pin of the interface. The engagement of the first pin and the first engaging portion allows coupling of the interface with the stick of the machine.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
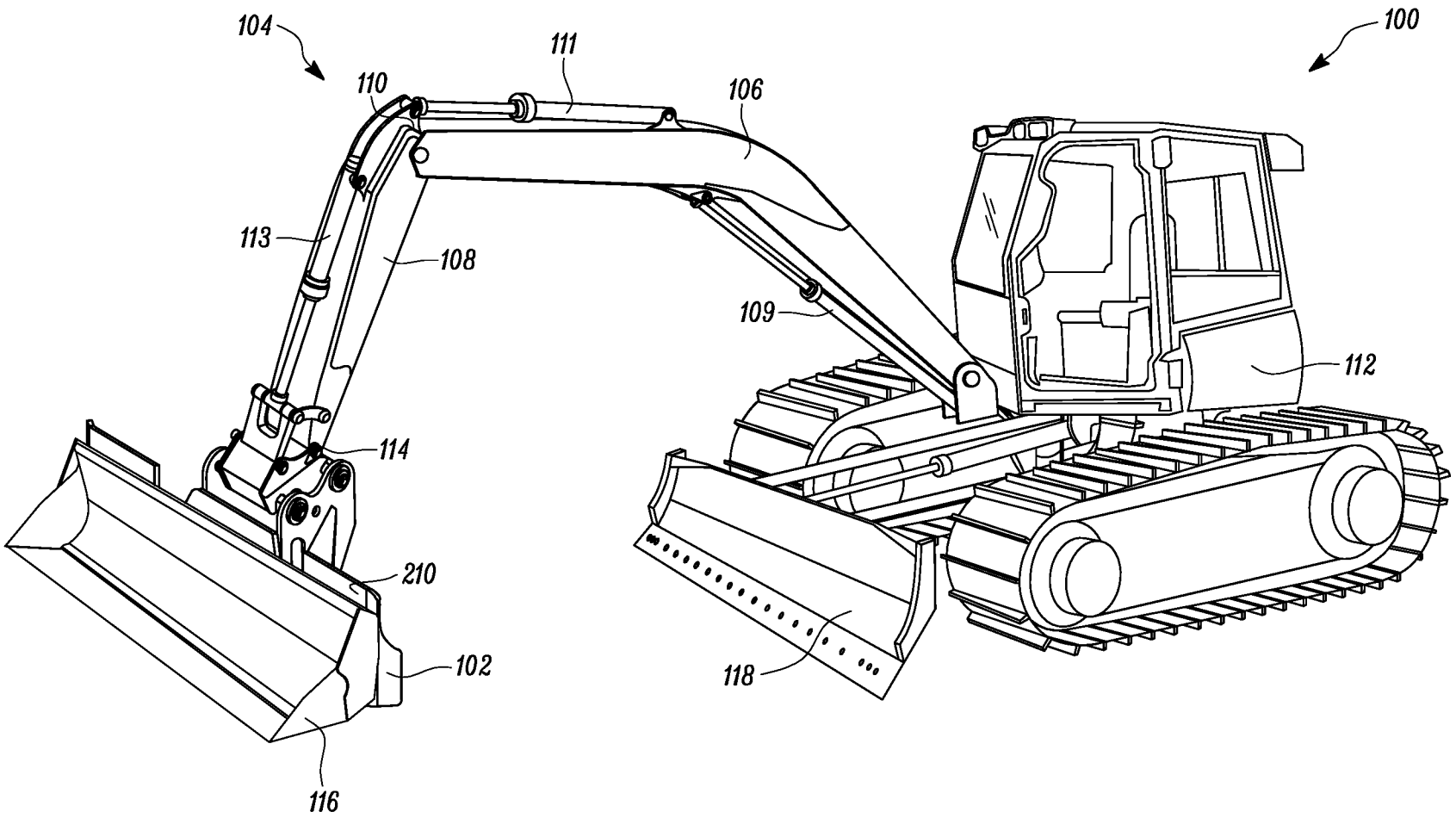
FIG. 1 is a perspective view of a machine equipped with an interface, according to an embodiment of the present disclosure.

Referring to FIG. 1, according to an embodiment of the present disclosure, a perspective view of a machine 100 equipped with an interface 102 is illustrated. In the present embodiment, the machine 100 is a mini-hydraulic excavator. However, the machine 100 may be embodied as a hydraulic mining shovel, a material handler, or a crane required to perform various tasks with the aid of various work tools. A boom assembly 104 is connected to the machine 100. The boom assembly 104 of the machine 100 includes a boom 106 and a stick 108. The stick 108 includes a first end 110 pivotally coupled to a frame 112 of the machine 100 via the boom 106. Specifically, the boom 106 is pivotally coupled to the frame 112 and the stick 108 is pivotally coupled to the boom 106. The boom 106 is raised and lowered by a first hydraulic actuator 109 and the stick 108 is moved toward and outward with respect to the boom 106 by a second hydraulic actuator 111. The interface 102 is coupled to a second end 114 of the stick 108 and aids in coupling a work tool 116 to the stick 108. A third hydraulic actuator 113 of the machine 100 is used to operate the interface 102 relative to the stick 108. Although the work tool 116 is illustrated as a multi-purpose bucket, the work tool 116 may be embodied as, but not limited to, a trencher or a fork carriage. The machine 100 also includes a blade 118, also referred to as moldboard, attached to the frame 112 of the machine 100.

Figure 2:
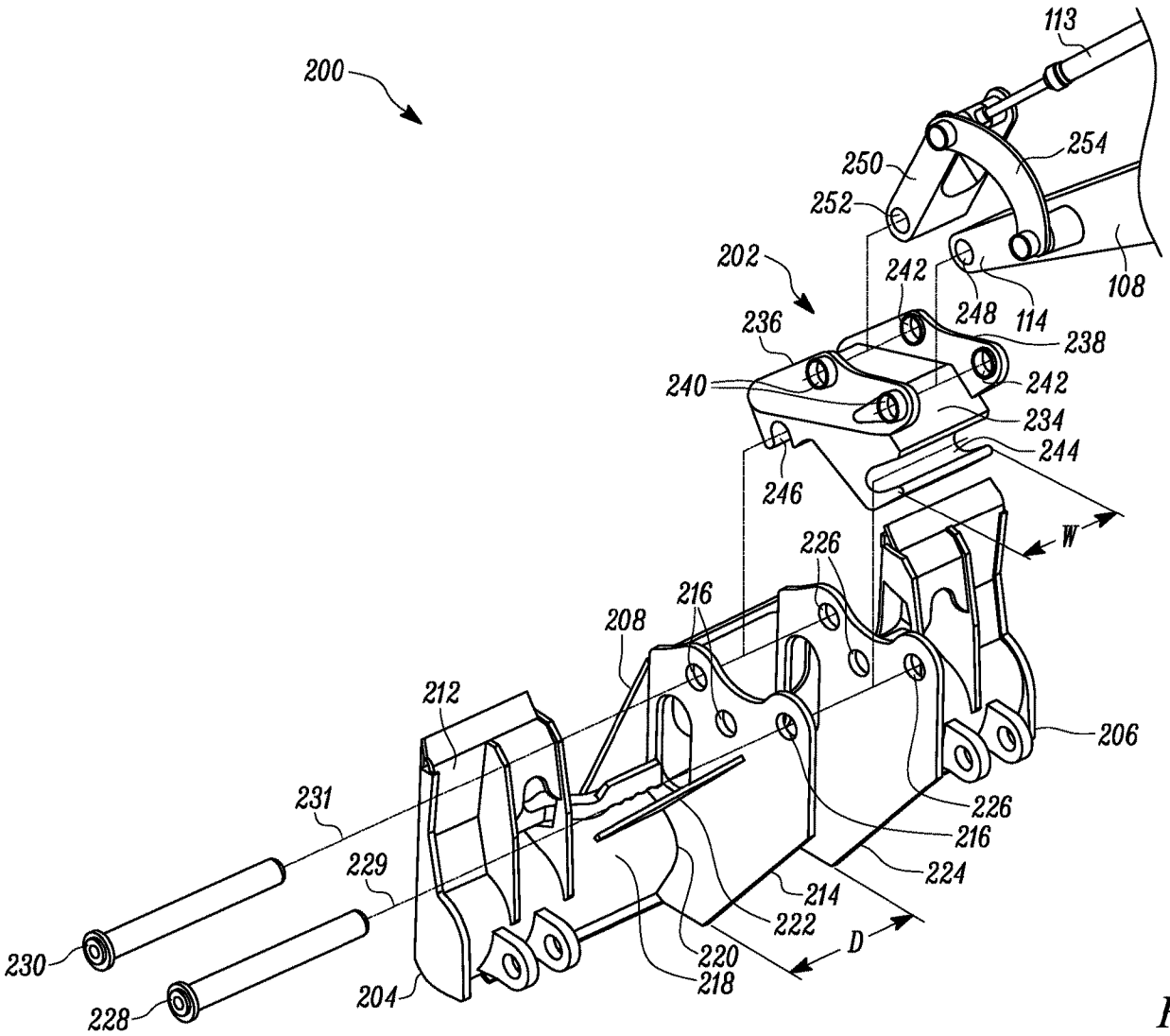
FIG. 2 is an exploded view of a coupling assembly including the interface, according to an embodiment of the present disclosure.

FIG. 2 illustrates an exploded view of a coupling assembly 200. The interface 102, a coupling member 202, and the second end 114 of the stick 108 constitute the coupling assembly 200. The interface 102 includes a first end 204, a second end 206, and a plate 208 extending between the first end 204 and the second end 206. In one embodiment, the plate 208 is provided as an elongated flat structural member having uniform thickness. The plate 208 includes multiple contours (not shown) and apertures (not shown) to enable coupling of various work tools to the interface 102. In an example, the plate 208 may be molded using Carbon Steel material. Further, the plate 208 includes an engaging face 210 (as shown in FIG. 1) and a coupling face 212 opposite to the engaging face 210. While the engaging face 210 includes the multiple contours and the apertures to assist in connecting the plate 208 to the work tool 116, the coupling face 212 includes multiple structural elements to assist in connecting the plate 208 to the machine 100.

In one embodiment, the interface 102 includes a first bracket 214 extending from the coupling face 212 of the plate 208. The first bracket 214 is embodied as a flat plate-like structure having uniform thickness. However, the first bracket 214 may also include a linearly varying thickness along a length of the first bracket 214. Shape and size of the first bracket 214 can be predetermined. In one example, the first bracket 214 can be molded using Carbon Steel material. Further, the first bracket 214 is attached to the coupling face 212 such that the first bracket 214 is perpendicular to the plate 208. In one example, the first bracket 214 may also be attached inclined to the coupling face 212 of the plate 208. Contacting portions of the first bracket 214 and the plate 208 can be welded to retain the first bracket 214 attached to the plate 208. In one example, the contacting portions can be attached in any manner known in the art. In this embodiment, the first bracket 214 includes at least one first hole 216, hereinafter individually referred to as the hole 216 or commonly referred to as the holes 216. Specifically, the first bracket 214 includes three holes 216 located along a periphery of the first bracket 214, as shown in FIG. 2.

In one embodiment, the coupling face 212 of the plate 208 may include an arcuate portion 218 extending between the first end 204 and the second end 206 of the interface 102. With such arcuate portion 218, the first bracket 214 can be accordingly manufactured to include a complimentary arc 220 to conform to the arcuate portion 218. In order to add to structural stability of the first bracket 214, the interface 102 includes a first rib 222 attached to the coupling face 212 and the first bracket 214. The first rib 222 extends towards the first end 204 of the interface 102. In cases where the coupling face 212 includes the arcuate portion 218, the first rib 222 is welded to the first bracket 214 and the arcuate portion 218.

The interface 102 further includes a second bracket 224 extending from the coupling face 212 of the plate 208. The second bracket 224 may be identical to the first bracket 214 with respect to shape, size, and configuration. For instance, the second bracket 224 includes at least one second hole 226, hereinafter individually referred to as the hole 226 or commonly referred to as the holes 226. As illustrated in FIG. 2, the second bracket 224 includes three holes 226 along a periphery of the second bracket 224. Further, the second bracket 224 is positioned at a predefined distance 'D1' from the first bracket 214 and is welded to the coupling face 212 of the plate 208. In a welded condition, the second bracket 224 extends perpendicularly from the coupling face 212. In one embodiment, the second bracket 224 may also extend in an inclined manner with respect to the coupling face 212 of the plate 208. In another embodiment, both the first bracket 214 and the second bracket 224 may extend in an inclined manner from the coupling face 212 of the plate 208. In these embodiments, the holes 226 of the second bracket 224 are aligned with the holes 216 of the first bracket 214. Specifically, each hole 226 of the second bracket 224 is aligned with one hole 216 of the first bracket 214. Further, a second rib (not shown) can be provided attached to the coupling face 212 and the second bracket 224, such that the second rib extends towards the second end 206 of the interface 102. In one example, the first rib 222 and the second rib can be provided as, but not limited to, triangular brackets.

The interface 102 further includes a first pin 228 coaxially received through the aligned holes 216 and 226 along a first common axis 229. The first pin 228 is embodied as a cylinder having a length 'L'. However, in one example, cross-section of the first pin 228 can be, but not limited to, a square or an oval. Shape of the holes 216 and 226 receiving the first pin 228 may correspond to the cross-section of the first pin 228, so that peripheries of the holes 216 and 226 conform to an outer surface of the first pin 228. Such arrangement ensures rigid engagement between the first pin 228, the first bracket 214, and the second bracket 224. The length 'L' of the first pin 228 may be greater than the predefined distance 'D1' between the first bracket 214 and the second bracket 224. As such, the first pin 228 extends beyond the second bracket 224 when received through the holes 216 and 226.

In addition to the first pin 228, the interface 102 can also include a second pin 230. The second pin 230 is identical to the first pin 228 with respect to shape, size, and configuration. In the aligned condition of the holes 216 and the holes 226, the second pin 230 is coaxially received through the aligned holes 216 and 226 along second common axis 231.

The machine 100 further includes the coupling member 202 for coupling the interface 102 with the stick 108 of the machine 100. The coupling member 202 includes a coupler body 234 and a pair of sidewall members, such as a first sidewall member 236 and a second sidewall member 238, attached to the coupler body 234. The first sidewall member 236 and the second sidewall member 238 are spaced apart to a predefined distance 'D2' therebetween and a width 'W' of the coupling member 202. The width 'W' of the coupling member 202 is less than the predefined distance 'D1' defined between the first bracket 214 and the second bracket 224. Each of the first sidewall member 236 and the second sidewall member 238 includes a pair of apertures, such as the first pair of apertures 240 and the second pair of apertures 242, respectively. The first pair of apertures 240 is aligned with the second pair of apertures 242.

The coupler body 234 further includes a first engaging portion 244 and a second engaging portion 246 distant from the first engaging portion 244. The first engaging portion 244 is configured to engage with the first pin 228 and the second engaging portion 246 is configured to engage with the second pin 230. It will be understood that the first and second engaging portions 244, 246 may have a cross-section corresponding to cross-section of the first pin 228 and the second pin 230, respectively, so that the first and second engaging portions 244, 246 conform to surface of the first pin 228 and the second pin 230. In one example, distance between the first engaging portion 244 and the second engaging portion 246 may be designed based on distance between the first pin 228 and the second pin 230 in an engaged condition of the pins 228, 230 and the brackets 214, 224. In another example, based on the distance between engaging portions 224, 246 of the coupling member 202, the pins 228 and 230 can be attached to the brackets 214, 224.

Further, the second end 114 of the stick 108 includes a first engaging aperture 248, and a coupling arm 250 includes a second engaging aperture 252, provided to engage with the first pair of apertures 240 and the second pair of apertures 242. The coupling arm 250 is connected to the stick 108 via a connecting element 254 and actuated by the hydraulic actuator 113 of the machine 100.

Figure 3:
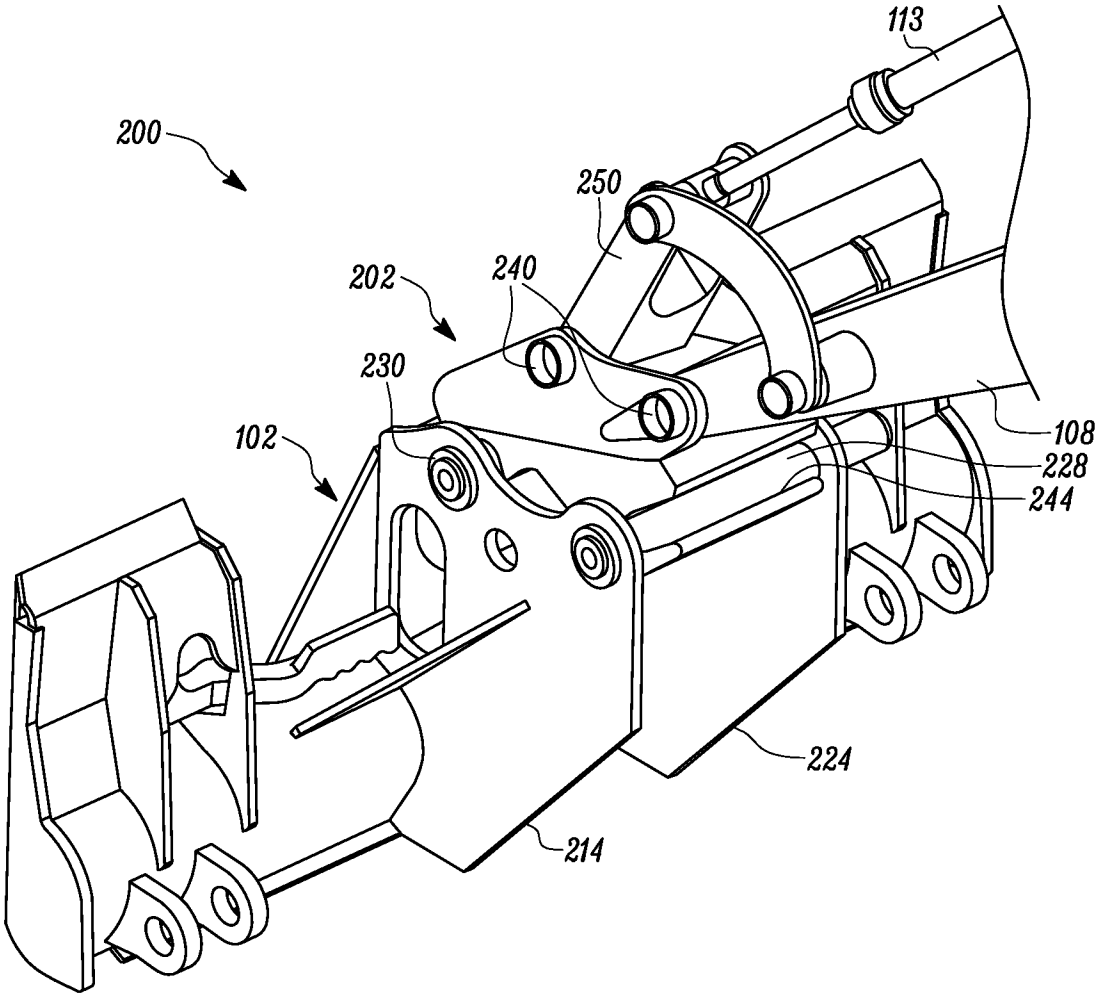
FIG. 3 is a perspective view of the coupling assembly in an assembled condition, according to an embodiment of the present disclosure.

A perspective view of an assembled condition of the coupling assembly 200 is illustrated in FIG. 3. In one embodiment, once the first pin 228 and the second pin 230 are received within the holes 216 and 226, the first pin 228 and the second pin 230 are welded to the first bracket 214 and the second bracket 224. In another embodiment, cotter pins (not shown) can be used at portions of the pins 228, 230 extending beyond the second bracket 224, to retain the pins 228, 230 engaged with the first bracket 214 and the second bracket 224. In this engaged condition of the pins 228, 230 and the brackets 214, 224, the coupling member 202 can be aligned with respect to the brackets 214, 224. For instance, the coupling member 202 can be positioned above the interface 102 such that the first engaging portion 244 and the second engaging portion 246 are aligned with the first pin 228 and the second pin 230, respectively.

Since width 'W' of the coupling member 202 is less than the predefined distance 'D1' defined between the first bracket 214 and the second bracket 224, the coupling member 202 is received within the predefined distance 'D1'. Further, the first engaging portion 244 is engaged with the first pin 228 and the second engaging portion 246 is engaged with the second pin 230. Subsequent to the engagement of the coupling member 202 and the interface 102, the stick 108 and the coupling arm 250 are engaged with the coupling member 202.

Furthermore, the second end 114 of the stick 108 is positioned between the first sidewall member 236 and the second sidewall member 238 of the coupling member 202 to align the first engaging aperture 248 with the holes 216 and 226. Similarly, the second engaging aperture 252 of the coupling arm 250 is also aligned with the holes 216 and 226. Additional engaging pins (not shown) are inserted through the aligned holes 216, 226 and the engaging apertures 248, 252 to couple the stick 108 with the coupling member 202. As such, the coupling member 202 allows coupling of the interface 102 with the stick 108 of the machine 100. Specifically, engagement of the first pin 228 and the first engaging portion 244 of the coupling member 202 allows coupling of the interface 102 with the stick 108 of the machine 100.

Figure 4:
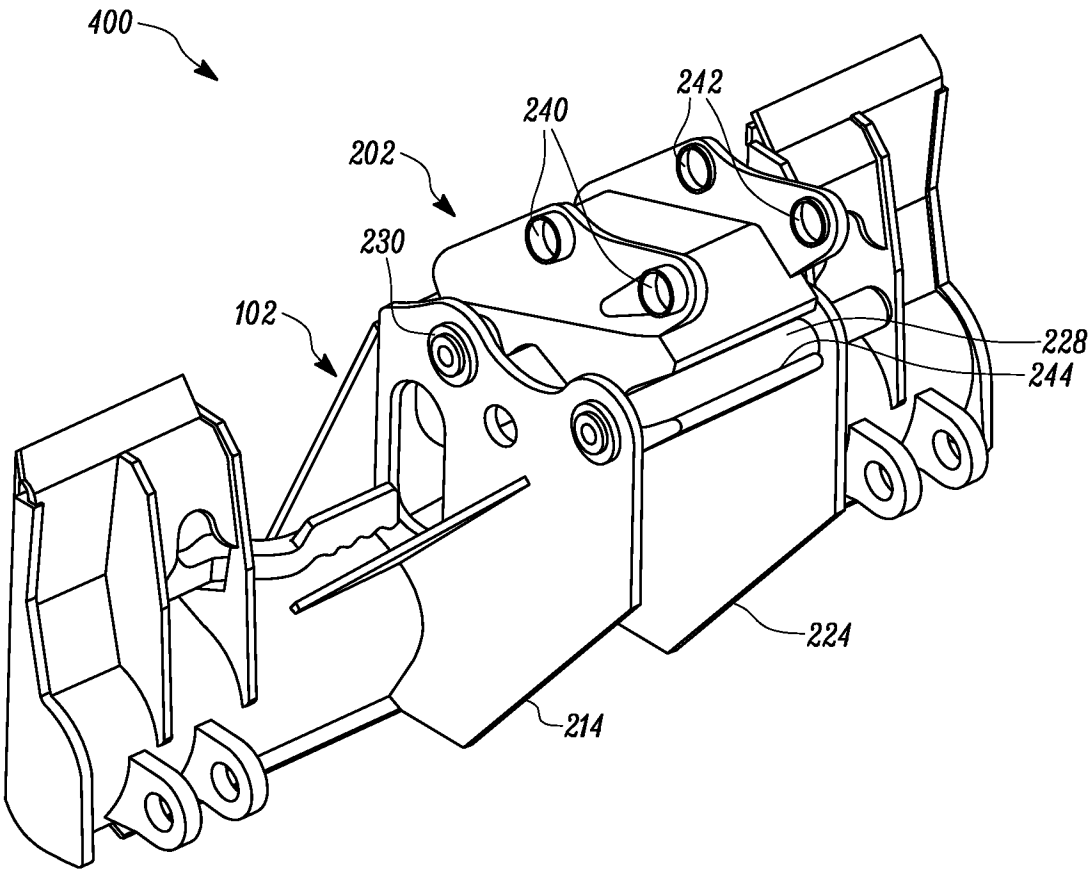
FIG. 4 is a perspective view of an interface assembly, according to an embodiment of the present disclosure.

FIG. 4 illustrates a perspective view of an interface assembly 400. The coupling member 202 engaged with the interface 102 constitutes the interface assembly 400. In one embodiment, the interface assembly 400 can be provided as a single component, where the coupling member 202 is integrated with the interface 102.

Various embodiments disclosed herein are to be taken in the illustrative and explanatory sense, and should in no way be construed as limitations to the present disclosure.

INDUSTRIAL APPLICABILITY

The present disclosure relates to the interface 102 for coupling the work tool 116 to the stick 108 of the machine 100. As described earlier, the interface 102 includes the brackets 214, 224 and pins 228, 230 attached to the brackets 214, 224. These pins 228, 230 are capable of engaging with the engaging portions 244, 246 of the coupling member 202, thereby allowing the interface 102 to be coupled with the stick 108 of the machine 100. The present disclosure also provides the interface assembly 400 to enhance flexibility of coupling various work tools to the machine 100.

For instance, other work tools, such as a fork carriage and a trencher, which are employed on a skid-steer loader machine, can now be coupled to the stick 108 of the machine 100 via the interface 102 or the interface assembly 400. Therefore, the machine 100 whilst being, for example, the mini-hydraulic excavator, can be employed to perform various other jobs besides material handling.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An interface for coupling a work tool to a stick of a machine, the interface comprising:

a coupling member;

a plate having an engaging face and a coupling face opposite to the engaging face, the engaging face connected to the work tool;

a first bracket extending from the coupling face of the plate and comprising at least a first set of first holes;

a second bracket extending from the coupling face of the plate and comprising at least a second set of second holes respectively aligned with the first set of first holes, the second bracket being positioned at a predefined distance from the first bracket; and a first pin received through one first hole of the first set of first holes and the aligned one second hole of the second set of second holes, the first pin connected to the coupling member via engagement to a first engaging portion of the coupling member, wherein the coupling member is connected to the stick of the machine via at least a set of apertures, the set of apertures being different and offset from the first set of first holes, the second set of second holes, and the first engaging portion in a height direction of the coupling member that is perpendicular to a length-wise direction of the first pin, wherein the coupling member is configured to couple the work tool to the stick of the machine via the set of apertures, wherein the first holes of the first set of first holes, the second holes of the second set of second holes, and the apertures have respective axes that are parallel to each other, wherein, in a side view of the interface, a portion of the coupling member is above the first bracket and the second bracket when the coupling member is received within the predefined distance defined between the first bracket and the second bracket and wherein the portion of the coupling member, when the coupling member is received within the predefined distance defined between the first bracket and the second bracket, is centered and symmetrical about a vertical plane, which runs through a center of the interface, that is perpendicular to the respective axes of the apertures that are parallel to each other.

2. The interface of claim 1, wherein each of the first bracket and the second bracket extend perpendicularly from the coupling face of the plate.

3. The interface of claim 1 further comprising a second pin configured to engage with a second engaging portion of the coupling member.

4. The interface of claim 1 further comprising:

a first rib attached to the coupling face and the first bracket, the first rib extending towards a first end of the coupling face; and a second rib attached to the coupling face and the second bracket, the second rib extending towards a second end of the coupling face.

5. A machine comprising:

a frame;

a stick having a first end and a second end, the first end of the stick pivotally coupled to the frame;

an interface configured to couple a work tool to the stick, the interface comprising:

a plate having an engaging face and a coupling face opposite to the engaging face, the engaging face connected to the work tool;

a first bracket extending from the coupling face of the plate and comprising at least a first set of first holes;

a second bracket extending from the coupling face of the plate and comprising at least a second set of second holes respectively aligned with the first set of first holes, the second bracket being positioned at a predefined distance from the first bracket; and a first pin received through one first hole of the first set of first holes and the aligned one second hole of the second set of second holes; and a coupling member including a first engaging portion configured to engage with the first pin of the interface, wherein the engagement of the first pin and the first engaging portion allows coupling of the interface with the stick of the machine, wherein the coupling member is connected to the stick of the machine via at least a set of apertures, the set of apertures being different and offset from the first set of first holes, the second set of second holes, and the first engaging portion in a height direction of the coupling member that is perpendicular to a length-wise direction of the first pin, wherein the coupling member is configured to couple the work tool to the stick of the machine via the set of apertures, wherein the first holes of the first set of first holes, the second holes of the second set of second holes, and the apertures have respective axes that are parallel to each other, wherein, in a side view of the interface, a portion of the coupling member is above the first bracket and the second bracket when the coupling member is received within the predefined distance defined between the first bracket and the second bracket and wherein the portion of the coupling member, when the coupling member is received within the predefined distance defined between the first bracket and the second bracket, is centered and symmetrical about a vertical plane, which runs through a center of the interface, that is perpendicular to the respective axes of the apertures that are parallel to each other.

6. The machine of claim 5, wherein the interface comprises a second pin configured to engage with a second engaging portion of the coupling member.

7. The machine of claim 5, wherein each of the first bracket and the second bracket extend perpendicularly from the coupling face of the plate.

8. The machine of claim 5, wherein the coupling member is pivotally coupled to the stick of the excavator.

9. An interface assembly for coupling a work tool to a stick of a machine, the interface assembly comprising:

an interface including:

a plate having an engaging face and a coupling face opposite to the engaging face, the engaging face connected to the work tool;

a first bracket extending from the coupling face of the plate and comprising at least a first set of first holes;

a second bracket extending from the coupling face of the plate and comprising at least a second set of second holes respectively aligned with the first set of first holes, the second bracket being positioned at a predefined distance from the first bracket; and a first pin received through one first hole of the first set of first holes and the aligned one second hole of the second set of second holes; and a coupling member including a first engaging portion configured to engage with the first pin of the interface, wherein the engagement of the first pin and the first engaging portion allows coupling of the interface with the stick of the machine, wherein the coupling member is connected to the stick of the machine via at least a set of apertures, the set of apertures being different and offset from the first set of first holes, the second set of second holes, and the first engaging portion in a height direction of the coupling member that is perpendicular to a length-wise direction of the first pin, wherein the coupling member is configured to couple the work tool to the stick of the machine via the set of apertures, wherein the first holes of the first set of first holes, the second holes of the second set of second holes, and the apertures have respective axes that are parallel to each other, wherein, in a side view of the interface, a portion of the coupling member is above the first bracket and the second bracket and wherein the portion of the coupling member, when the coupling member is received within the predefined distance defined between the first bracket and the second bracket, is centered and symmetrical about a vertical plane, which runs through a center of the interface, that is perpendicular to the respective axes of the apertures that are parallel to each other.

10. The interface assembly of claim 9, wherein the interface comprises a second pin configured to engage with a second engaging portion of the coupling member.

11. The interface assembly of claim 9, wherein the coupling member is received within the predefined distance defined between the first bracket and the second bracket.

12. The interface assembly as claimed in claim 9, wherein the coupling member is pivotally coupled to the stick of the excavator.

* * * * *